US006234119B1

(12) United States Patent
Tsukada et al.

(10) Patent No.: US 6,234,119 B1
(45) Date of Patent: May 22, 2001

(54) PROCESS FOR CONTROLLING A CHANGE-OVER OF A ROTATIVE DIRECTION OF A TWO CYCLE INTERNAL COMBUSTION ENGINE USED FOR DRIVING A TRAVELLING MACHINE

(75) Inventors: Yoshikazu Tsukada; Kouji Sasaki, both of Numazu (JP)

(73) Assignee: Kokusan Denki Co., Ltd., Shizouka-ken (JP)

( * ) Notice: Subject to any disclaimer, the term of this patent is extended or adjusted under 35 U.S.C. 154(b) by 0 days.

(21) Appl. No.: 09/373,407

(22) Filed: Aug. 12, 1999

(30) Foreign Application Priority Data

Aug. 21, 1998 (JP) ..... 10-235676

(51) Int. Cl.[7] ..... F01L 13/02
(52) U.S. Cl. ..... 123/41 R; 123/41 E
(58) Field of Search ..... 123/41 E, 41 R

(56) References Cited

U.S. PATENT DOCUMENTS

| | | | |
|---|---|---|---|
| 5,036,802 | 8/1991 | D'Amours | 123/41 E |
| 5,782,210 | 7/1998 | Venturoli et al. | 123/41 E |
| 5,794,574 | 8/1998 | Bostelmann et al. | 123/41 E |
| 5,964,191 * | 10/1999 | Hata | 123/41 E |

* cited by examiner

*Primary Examiner*—Willis R. Wolfe
*Assistant Examiner*—Katrina B. Harris
(74) *Attorney, Agent, or Firm*—Pearne & Gordon LLP

(57) ABSTRACT

A process for controlling a change-over of a rotative direction of a two cycle internal combustion engine used for driving a travelling machine such as a scooter, a snowmobile, a buggy car or the like wherein the rotative direction of the engine is reversed by advancing an ignition position to an over spark advance position just when it is confirmed that reversion allowance conditions are satisfied which are required for reversing the rotative direction of the engine while the travelling machine is driven with safety maintained.

6 Claims, 8 Drawing Sheets

PROCESS FOR CONTROLLING A CHANGE-OVER OF A ROTATIVE DIRECTION OF A TWO CYCLE INTERNAL COMBUSTION ENGINE USED FOR DRIVING A TRAVELLING MACHINE

TECHNICAL FIELD OF THE INVENTION

This invention pertains to a process for controlling a change-over of a rotative direction of a two cycle internal combustion engine which is used for driving a travelling machine and a system used for practicing the aforementioned process.

BACKGROUND OF THE INVENTION

In order to drive a travelling machine such as a scooter, a snowmobile, a buggy car or the like which makes much of simplicity, there has been used a small-sized two cycle internal combustion engine as a drive power and a centrifugal clutch type continuously variable transmission as a transmission to transmit an output power of the internal combustion engine to drive wheels of the travelling machine. Many travelling machines have no reverse gear assembled in the continuously variable transmission from a requirement of important items of small-size, lightness and inexpensiveness.

Since vehicles having no reverse gear assembled in the transmission cannot move in a backward direction, they have to change their direction by lifting the whole vehicles when their travelling direction should be reversed, which causes them to have a poor manipulation.

In order to enable reversion of the travelling direction of the travelling machine having no reverse gear provided therein, the rotative direction of the internal combustion engine has to be reversed, as required.

The two cycle internal combustion engine can rotate in both of forward and reverse directions and can be normally driven either in the forward direction and in the reverse direction.

More particularly, as an ignition position (an angular position of a rotary shaft of the two cycle internal combustion engine as it is ignited) of the engine is advanced to an over spark advance position (a position further advancing beyond the optimum maximum spark advance position on its normal operation), a piston moving toward a top dead center thereof is forced back far away from the top dead center so that the rotative direction of the engine is reversed. After the reversion of the rotative direction of the engine is checked, the ignition position is returned to the optimum ignition position where the rotative direction of the engine reverse to the former direction can be maintained. Thus, the two cycle internal combustion engine can continue to rotate in the condition in which the rotative direction is reversed.

There has been well known a process in which the rotative direction of the two cycle internal combustion engine is reversed by controlling its reversion while the ignition position of the engine is advanced to the over spark advance position necessary for reversing the rotative direction of the engine when a reversion instruction is given instructing the reversion of the engine.

FIG. 9 illustrates an algorithm of interruption routine which is conducted by a microcomputer as a reversion instruction is generated by a driver when a rotative direction instruction switch is operated in a prior art process for controlling the change-over of the rotative direction of the engine.

With this algorithm followed, when the reversion instruction is given, a step 1 of FIG. 9 is conducted wherein it is confirmed whether the rotative direction of the engine being now driven is identical to that instructed by the driver.

As a result of the confirmation of the step 1, when it is confirmed that the rotative direction of the engine being now driven is not identical to that instructed by the driver, the process is moved to a step 2 of FIG. 9 wherein the reversion control is made. In this reversion control, the ignition position of the engine is advanced to the over spark advance position necessary for reversing the rotative direction of the engine and the over spark advance condition of the ignition position is maintained until the reversion of the rotative direction of the engine is confirmed.

In the reversion control of the step 2, as the reversion of the rotative direction of the engine is confirmed, the process is moved to a step 3 of FIG. 9 wherein the ignition control is moved to the normal ignition position while the rotative direction is maintained in the reverse condition. Thus, the engine continues to be driven in the condition of reversion of the rotative direction of the engine.

With the algorithm of FIG. 9 followed, if the driver unintentionally operates the rotative direction instruction switch during travelling, or if a reversion instruction generator means such as a rotative direction instruction switch breaks down, then the travelling machine will quickly move back because the engine abruptly rotates in the reverse direction.

If the throttle valve is in the state of being opened even though the travelling machine is at a stop when the driver operates the rotative direction instruction switch, the travelling machine will disadvantageously travel in an abrupt manner because the engine is quickly accelerated as soon as the rotative direction of the engine is reversed.

These undesirable conditions should be avoided in order to make a practical use of the travelling machine having a system of reversing its travelling direction by reversing the rotative direction of the engine mounted thereon.

SUMMARY OF THE INVENTION

Accordingly, it is a principal object of the invention to provide a process of controlling a change-over of a rotative direction of a two cycle internal combustion engine adapted to avoid reversion of the rotative direction of the engine when a reversion instruction is erroneously generated due to an unintentional operation by the driver or due to a reversion instruction generator broken down in the conditions of the undesirable reversion of the engine.

It is another object of the invention to provide a system of controlling a change-over of a rotative direction of a two cycle internal combustion engine adapted to avoid reversion of the rotative direction of the engine when a reversion instruction is erroneously generated due to an unintentional operation by the driver or due to a reversion instruction generator broken down in the conditions of the undesirable reversion of the engine.

In accordance with one aspect of the present invention, there is provided a process of controlling a change-over of a rotative direction of a two cycle internal combustion engine used for driving a travelling machine comprising the steps of controlling the change-over of the rotative direction of the engine by advancing an ignition position of the engine to an over spark advance position necessary for reversing the rotative direction of the engine when a reversion instruction is given instructing the reversion of the rotative direction of the engine; confirming whether reversion allowance conditions are satisfied which are required for reversing the rotative direction of the engine while the travelling machine is driven with safety maintained before the step of controlling the change-over of the rotative direction of the engine whereby the step of controlling the change-over is allowed to start when it is confirmed by the step of confirming the reversion allowance conditions that the reversion allowance conditions are satisfied, but the step of controlling the change-over is prohibited from starting when it is confirmed that at least one of the reversion allowance conditions is dissatisfied.

In the step of confirming the reversion allowance conditions, they preferably include a revolution of the internal combustion engine being equal to or less than a set value and an opening degree of the throttle valve for adjusting an intake amount of the internal combustion engine being equal to or less than a set value.

More particularly, in the step of confirming the reversion allowance conditions before the step of controlling the reversion starts, the satisfaction of the reversion allowance conditions is confirmed when the revolution of the internal combustion engine is equal to or less than the set value, which means that the revolution of the engine is sufficiently lower for never providing any undesirable situation to the driver when the rotative direction of the engine is reversed and also when the opening degree of the throttle valve is equal to or less than the set value while the dissatisfaction of the reversion allowance conditions is confirmed when the revolution of the internal combustion engine exceeds the set value and/or when the opening degree of the throttle valve exceeds the set value.

The set value of the revolution of the engine to be determined as one of the reversion allowance conditions may be less than the revolution at which a centrifugal clutch for transmitting an output power of the engine to drive wheels of the travelling machine is made engaged or at which a torque converter provided between an output shaft of the engine and the drive wheels of the travelling machine starts to transmit the output power from the engine to the drive wheels.

In addition thereto, in the step of confirming the reversion allowance conditions, they may also include a brake operating member such as a brake pedal being operated on a braking side together with the revolution of the engine being equal to or less than the set value.

More particularly, the satisfaction of the reversion allowance conditions is confirmed when the revolution of the internal combustion engine is equal to or less than the set value and also when the brake operating member is operated on the braking side while the dissatisfaction of the reversion allowance conditions is confirmed when the revolution of the internal combustion engine exceeds the set value and/or when the brake operating member is not operated on the braking side.

In the specification, the term "travelling machine" includes a scooter, a snowmobile, a cultivator, an outboard motor and the likes which are driven by the two cycle internal combustion engine.

In accordance with another aspect of the present invention, there is provided a system of controlling a change-over of a rotative direction of a two cycle internal combustion engine used for driving a travelling machine adapted to practice the aforementioned process and comprising reversion instruction generator means to generate a reversion instruction to instruct the rotative direction of the engine; safety confirmation means to determine whether reversion allowance conditions are satisfied which are required for reversing the rotative direction of the engine while the travelling machine is driven with safety maintained whereby the rotative direction of the engine is allowed to be reversed when it is confirmed that the reversion allowance conditions are satisfied, but the rotative direction of the engine is prohibited from being reversed when it is confirmed that at least one of the reversion allowance conditions is dissatisfied; and reversion control means to reverse the rotative direction of the internal combustion engine by advancing an ignition position of the engine to an over spark advance position necessary for reversing the rotative direction of the internal combustion engine when the reversion instruction is given and also when the reversion of the engine is allowed by the safety confirmation means.

In order to positively accomplish the reversion of the rotative direction of the internal combustion engine, the reversion control means should return the control of the ignition position to the normal operation control after the reversion of the rotative direction of the engine accomplished by advancing the ignition position of the engine to the over spark advance position is confirmed.

With the system of the invention constructed in accordance with the aforementioned manner, since the reversion operation of the engine is made only when the reversion allowance conditions are satisfied which are required for reversing the rotative direction of the engine while the travelling machine is driven with the safety maintained, the reversion of the rotative direction of the engine can be avoided when the reversion instruction is erroneously generated due to the unintentional operation by the driver or due to the reversion instruction generator broken down.

Furthermore, the system of the invention may preferably comprise rotative direction confirmation means to confirm whether the rotative direction of the internal combustion engine is identical to that which is instructed by the reversion instruction when the unfinished reversion of the rotative direction of the internal combustion engine is judged; and change-over interruption means to interrupt the reversion of the rotative direction of the engine by stopping advancing the ignition position to the over spark advance position by the reversion control means when the rotative direction confirmation means confirms that the rotative direction of the engine is identical to that instructed by the reversion instruction after the reversion operation starts.

With the system provided with the rotative direction confirmation means and the change-over interruption means as aforementioned, even after the driver operates the rotative direction instruction generator means so as to instruct the reversion of the rotative direction of the engine, the rotative direction of the engine is interrupted from being reversed if the driver returns the instruction generator means to the original position before the rotative direction of the engine is reversed. This prevents the rotative direction of the engine from being reversed against the intention of the driver.

BRIEF DESCRIPTION OF THE DRAWING

The above and other objects and features of the invention will be apparent from the description of the embodiments of the invention taken along with reference to the accompanying drawings in which.

DETAILED DESCRIPTION OF EMBODIMENTS OF THE INVENTION

Figure 1:
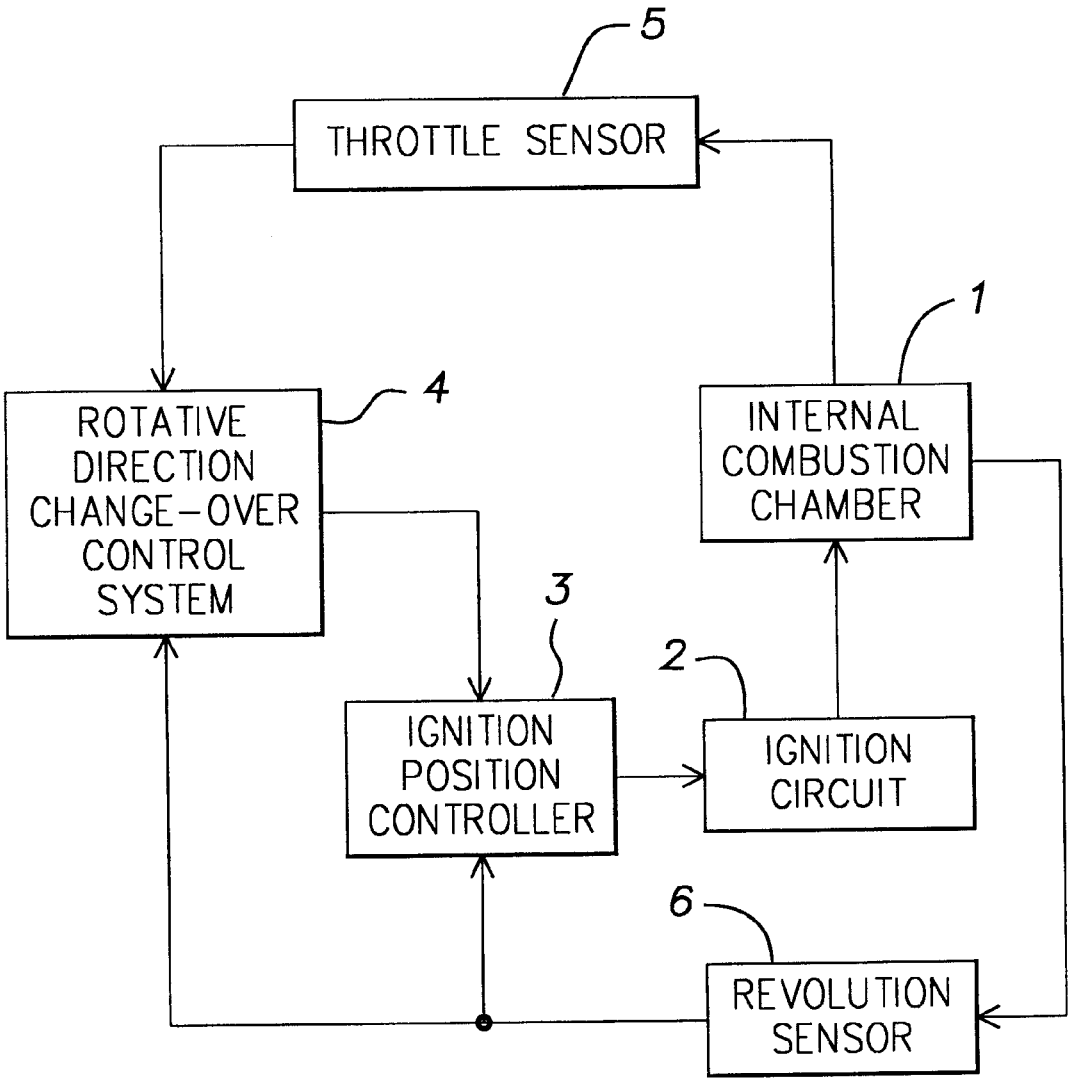
FIG. 1 is a schematic diagram of a control system for an internal combustion engine including a rotative direction change-over control system constructed in accordance with the invention.

Now referring to FIG. 1, there is shown a whole control system for an internal combustion engine to which a rotative direction change-over control system of the invention is applied.

The control system comprises an ignition circuit 2 to ignite a two cycle internal combustion engine 1 and an ignition position controller 3 to control an ignition position (a rotary angle position of a crank shaft of the engine) in accordance with a revolution of the internal combustion engine or other conditions when the ignition circuit 2 ignites the engine.

The control system further comprises a rotative direction change-over control system 4 to control the ignition position controller 3 so as to advance the ignition position of the engine to an over spark advance when a rotative direction of the engine is to be changed or reversed, a throttle sensor 5 to detect an opening degree of a throttle valve for adjusting an intake amount of the internal combustion engine and a revolution sensor 6 to detect a revolution of the internal combustion engine.

An output of the throttle sensor 5 is input to the rotative direction change-over control system 4 while an output of the revolution sensor 6 is input to the ignition position controller 3 and also to the rotative direction change-over control system 4.

An ignition circuit 2 comprises an ignition coil and a primary current controller. When an ignition signal is supplied from the ignition position controller 3 to the ignition circuit 2, a primary current through the ignition coil abruptly changes so as to generate an igniting high voltage across a secondary coil of the ignition coil. The igniting high voltage output from the ignition circuit 2 is applied to an ignition plug within a cylinder of the engine 1. Thus, the igniting high voltage causes the ignition plug to have a spark generated so as to ignite the engine.

The ignition position controller 3 serves to supply the ignition signal to the ignition circuit 2 so as to control the ignition position of the engine in accordance with the control conditions such as the revolution (r.p.m.) of the engine and so on. The ignition position controller 3 may comprise ignition position determination means to determine every instant ignition position in accordance with a rotary angle information on the crank shaft of the engine and a revolution information from the revolution sensor 6 and ignition signal output means to output the ignition signal at the determined ignition position. The ignition position determination means may be realized by the microcomputer and a predetermined program which is conducted by the microcomputer.

In the illustrated embodiment, the ignition position controller 3 has at least two control modes including a normal control mode which works when the engine is to be operated in a normal manner and a reversion control mode which works when the rotative direction of the engine is to be reversed. Unless there is given any reversion control instruction from the control mode change-over means described later, the ignition position is controlled in accordance with the normal control mode, but when the reversion control instruction is given, the ignition position is controlled in accordance with the reversion control mode so as to reverse the rotative direction of the engine.

In the normal control mode, the ignition position controller 3 serves to determine or operate the ignition position in accordance with control conditions such as the revolution of the engine and so on, which is accomplished by using an ignition position operation map memorized in the ROM of the microcomputer. It generates the ignition signal at the ignition position thus determined or operated so that the ignition circuit 2 makes an ignition operation.

In the reversion control mode, the ignition position controller 3 generates the ignition signal at the predetermined over spark advance position without using the ignition position operation map.

The throttle sensor 5 may comprise a position detection sensor such as a potentiometer, which serves to generate a throttle opening degree detection signal in accordance with the opening degree of the throttle valve and to supply it to the rotative direction change-over control system 4.

Figure 3:
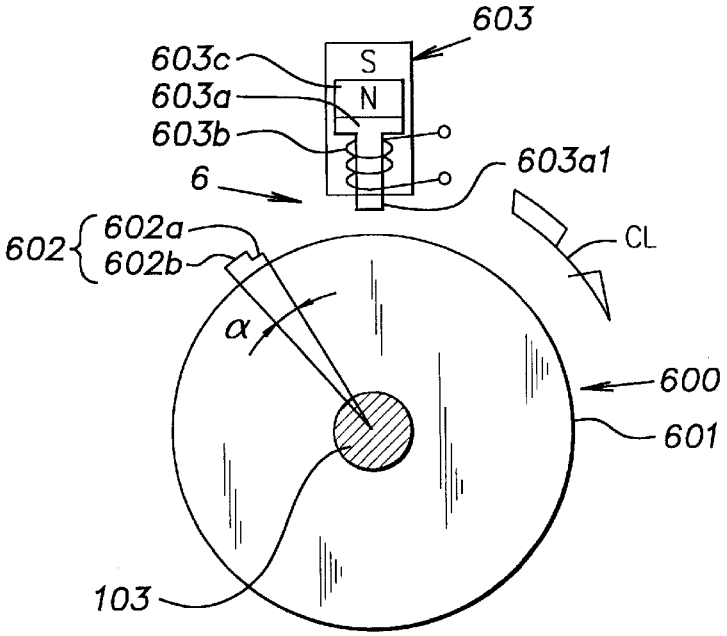
FIG. 3 illustrates in a plane view a revolution sensor to be used for the rotative direction change-over control system of the invention.

The revolution sensor 6 serves to generate a pulse signal including the revolution, the rotary angle and the rotative direction of the engine and may comprise an inductor type signal generator as shown in FIG. 3, for example.

A rotor 600 of the signal generator may comprise a rotary yoke 601 securely mounted on the crank shaft 103 of the engine and a two-step reluctor 602 formed on the outer periphery of the rotary yoke 601. The two-step reluctor 602 includes a first portion 602*a* formed on its one end as viewed in a peripheral direction of the rotor and a second portion 602*b* formed on the other end thereof. As shown in FIG. 3, the top face of the second portion 602*b* is so set outward of the top face of the first portion 602*a* that the second portion 602*b* becomes higher than the first portion 602*a* while an arc length (peripheral length) of the first portion 602*a* is so set to be shorter than that of the second portion 602*b*.

In the illustrated embodiment, the rotor 600 may be so positioned that the first portion 602*a* is located ahead of the second portion 602*b* as the engine rotates in a forward direction. The rotary yoke 601 may be of a flywheel mounted on the crank shaft.

An armature 603 of the signal generator may be disposed outward of the rotor 601 and attached to a stationary portion of a case or the like. As conventional, the armature 603 may comprise an iron core 603*a* having a magnetic pole 603*a*1 provided on the leading end thereof, a signal coil 603*b* wound on the iron core 603*a* and a permanent magnet 603*c* magnetically bonded to the iron core 603*a*. The armature 603 is disposed with the magnetic pole 603*a*1 faced to the peripheral face of the rotor 600 at a predetermined gap therebetween.

In the signal generator of FIG. 3, the magnetic flux interlinked with the signal coil 603*b* increases when the first portion 602*a* of the reluctor 602 is faced to the magnetic pole 603*a*1 of the armature 603 while the engine rotates in the forward direction CL and, the magnetic flux interlinked with the signal coil 603*b* further increases when the second portion 602*b* of the reluctor 602 is faced to the magnetic pole 603*a*1 of the armature 603. The signal coil 603*b* generates a pulse signal of different polarity whenever the interlinked magnetic flux increases and decreases.

Figure 4A:
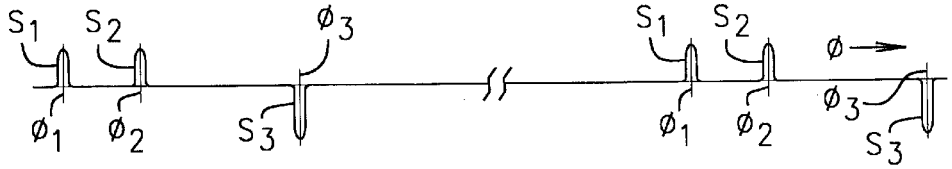
FIG. 4A illustrates waveforms provided by the revolution sensor of FIG. 3 when the engine rotates in a forward direction.
Figure 4B:
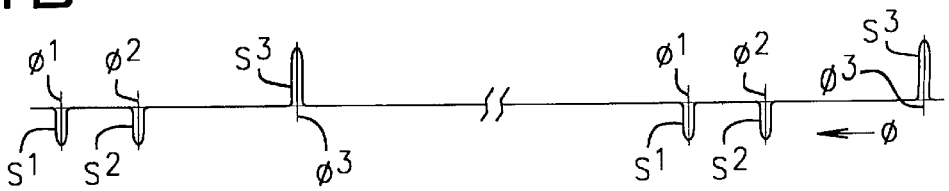
FIG. 4B illustrates waveforms provided by the revolution sensor of FIG. 3 when the engine rotates in a reverse direction.

The pulse signals induced in the signal coil 603*b* have waveforms varying relative to the rotary angle θ of the engine as shown in FIGS. 4A and 4B when the engine rotates in the forward direction and in the reverse direction, respectively.

As shown in FIG. 4A, as the engine rotates in the forward direction, the signal coil 603*b* generates the pulse signals S1 and S2 of one polarity (positive polarity in the illustrated embodiment) at the angular position θ1 where the first portion 602*a* of the reluctor 602 begins to be faced to the magnetic pole 603*a*1 of the armature 603 and at the angular position θ2 where the second portion 602*b* of the reluctor 602 begins to be faced to the magnetic pole 603*a*1 of the armature 603 and generates the pulse signal S3 of another polarity (negative polarity in the illustrated embodiment) at the angular position θ3 where the second portion 602*b* of the reluctor 602 terminates to be faced to the magnetic pole 603*a*1 of the armature 603.

As shown in FIG. 4B, as the engine rotates in the reverse direction, the signal coil 603*b* generates the pulse signal S3' of positive polarity at the angular position θ3 where the second portion 602*b* of the reluctor 602 begins to be faced to the magnetic pole 603*a*1 of the armature 603 and generates the pulse signals S2' and S1' of negative polarity at the angular position θ2 where the second portion 602*b* of the reluctor 602 terminates to be faced to the magnetic pole 603*a*1 of the armature 603 and at the angular position θ1 where the first portion 602*a* of the reluctor 602 terminates to be faced to the magnetic pole 603*a*1 of the armature 603.

Although the positions where the pulse signals generate are strictly ones where each of them reaches a threshold level (a level at which the circuit receiving the pulse signal can recognize), they are conveniently made the peak positions of the pulse signals in FIGS. 4A and 4B because a signal width of the pulse signals is fully narrow.

Since the signal generator of FIG. 3 generates the pulse signals having the different polarities and orders in accordance with the rotative direction of the engine, it will be noted that the rotative direction of the engine can be detected by the polarities and orders of the pulse signals induced in the signal coil 603*b*.

Thus, it will be understood that the rotative direction detection means to detect the rotative direction of the engine may comprise the revolution sensor 6 and means to judge the generation order of the pulse signal from the revolution sensor 6.

More particularly, in the illustrated embodiment, when it is detected that the signal coil 603*b* generates the positive polarity pulses S1 and S2 and the negative polarity pulse S3 in order, it is judged that the engine rotates in the forward direction and when it is detected that the signal coil 603*b* generates the positive polarity pulse S3' and the negative polarity pulses S2' and S1' in order, it is judged that the engine rotates in the reverse direction.

The revolution (r.p.m.) of the engine can be detected by the period after the pulse signal SI is generated and until the pulse signal S3 is generated.

With the arc angle α of the reluctor 602 set at a predetermined value and with the armature 603 so disposed that the center position of the reluctor 602 in a peripheral direction is faced to the center of the magnetic pole 603*a*1 of the armature 603 when the piston of the engine reaches the top dead center, the pulse signals S1 and S3' may be generated at the symmetrical position of α/2 before the top dead center of the piston when the engine rotates in the forward and reverse directions, respectively. The position where the pulse signal S1 is generated may be the minimum spark advance position when the engine rotates in the forward direction while the position where the pulse signal S3' is generated may be the minimum spark advance position when the engine rotates in the reverse direction.

What "the minimum spark advance position" means is the ignition position most close to the top dead center among the ignition positions when the engine rotates in the normal condition. This minimum spark advance position is one when the engine is idling.

The arc angle α of the reluctor 602 may be set at 10 degree or more or less, for example. With the arc angle of the reluctor 602 being set at 10 degree, the minimum spark advance position (the ignition position on idling of the engine) on the forward and reverse rotations of the engine will be at 5 degree before the top dead center.

The angle at which the position where the pulse signals are generated (the rotary angle position of the crank shaft) is defined will be required to be determined relative to a constant position. Normally, it is determined relative to the rotary angle position of the crank shaft when the piston of the engine reaches the top dead center.

The pulse signals from the revolution sensor 6 are converted by a not shown waveform shaping circuit into signals of waveform which the microcomputer can recognize and supplied to predetermined input ports of the microcomputer not shown of which the ignition position control 3 and the rotative direction change-over control 4 are formed. A throttle detection signal from the throttle sensor 5 is supplied also to the microcomputer.

The microcomputer receives the informations on the rotary angle of the engine, the revolution and the rotative direction of the engine from the revolution sensor 6 as well as the information on the opening degree of the throttle valve from the throttle sensor 5 and performs an operation for practicing the ignition position controller 3 and the rotative direction change-over control system 4, respectively.

Figure 2:
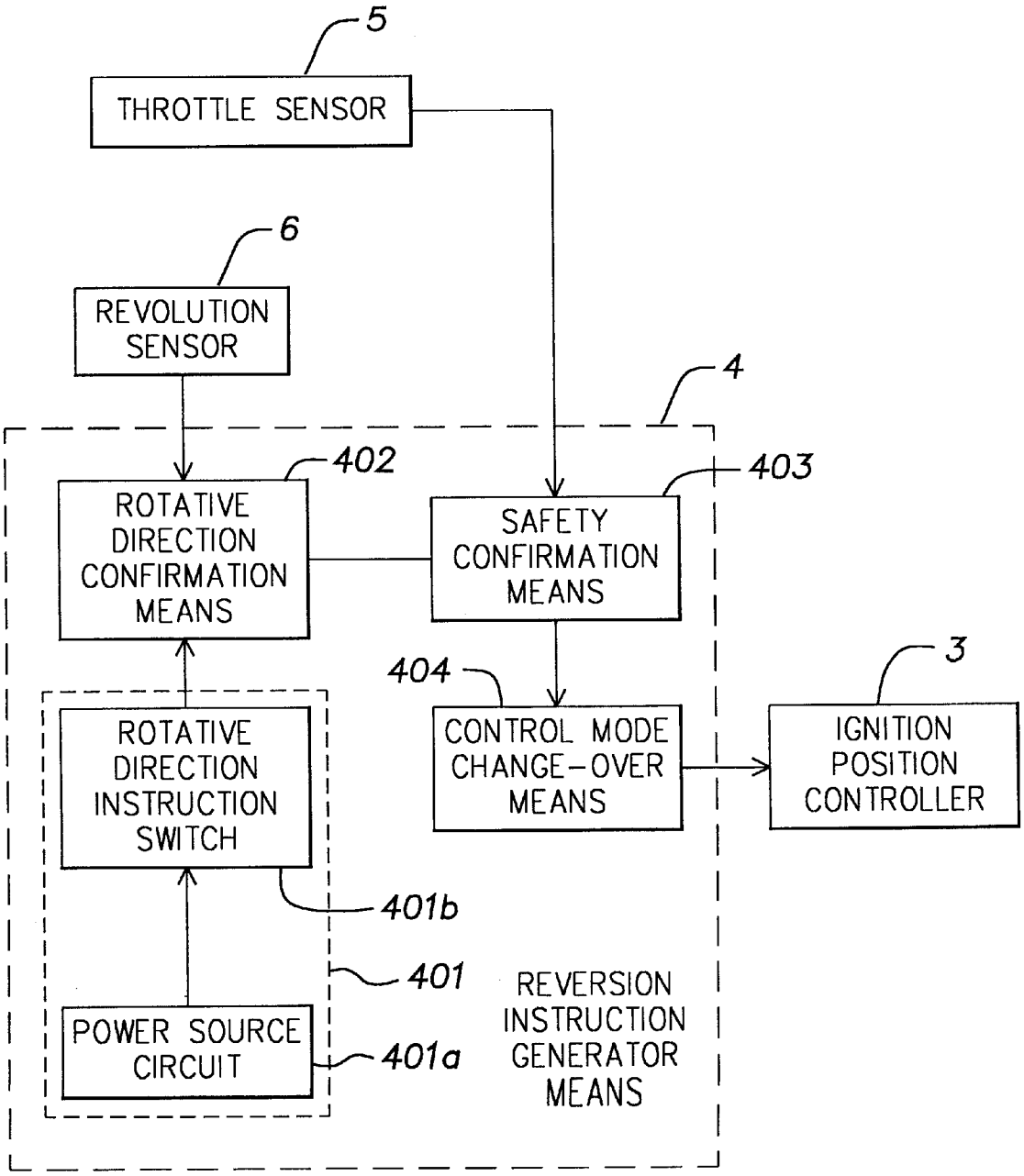
FIG. 2 is a schematic diagram of the rotative direction change-over control system shown in FIG. 1 and illustrated in more details.

As shown in FIG. 2, the rotative direction change-over control system 4 may comprise reverse instruction generation means 401 to generate a reversion instruction to instruct the rotative direction of the engine, rotative direction confirmation means 402 to judge or confirm whether the rotative direction of the internal combustion engine detected by the revolution sensor 6 is identical to that which is instructed by the reversion instruction generation means 401, safety confirmation means 403 to confirm safety on the reversion of the rotative direction of the engine by judging whether reversion allowance conditions are satisfied which are required for reversing the rotative direction of the engine when the reversion instruction is generated and also when the detected rotative direction of the engine is not identical to the rotative direction instructed by the reversion instruction, control mode change-over means 404 to supply a reversion control instruction to the ignition position controller 3 when the reversion instruction is generated and also when the satisfaction of the reversion allowance conditions is judged and to change the control mode of the ignition position controller 3 so that the ignition position of the internal combustion engine is advanced to the over spark advance position which is appropriate for reversing the rotative direction of the engine whereby the reversion of the rotative direction of the engine is accomplished.

The reversion instruction generation means 401 serves to generate the reversion instruction to instruct the rotative direction of the engine (a travelling direction of the travelling machine). In the illustrated embodiment, as shown in FIG. 2, the reversion instruction generation means 401 may comprise a power source circuit 401*a* to generate a constant DC voltage and a rotative direction instruction switch 401*b* to switch the output voltage of the power source circuit 401*a* relative to the rotative direction confirmation means 402. The rotative direction instruction switch 401*b* may be manually operated by the driver so that the condition of the switch (on-condition) when the engine should rotate in the forward direction is different from the condition of the switch (off-condition) when the engine should rotate in the reverse direction. Thus, it will be noted that when the engine should rotate in the forward direction or the travelling machine should travel in the forward direction, the switch 401*b* is in the off-condition, but when the engine should rotate in the reverse direction or the travelling machine should travel in the backward direction, the switch 401*b* is in the on-condition.

Whenever the rotative direction instruction switch 401*b* is changed over, the output signal from the switch 401*b* serves as the reversion instruction signal. The rotative direction instruction is made at a zero level when the engine should rotate in the forward direction while it is made at a high level when the engine should rotate in the reverse direction.

The rotative direction confirmation means 402 receives the reversion instruction signal applied through the rotative direction instruction switch 401*b* from the power source circuit 401*a* and the signal (including the information on the rotative direction of the engine) applied from the revolution sensor 6 and to confirm whether the rotative direction of the internal combustion engine detected by the revolution sensor 6 is identical to that which is instructed by the reversion instruction switch 401*b*. The rotative direction confirmation means 402 may comprise rotative direction detection means to detect the present rotative direction of the internal combustion engine and rotative direction judgement means to judge whether the rotative direction of the engine detected by the rotative direction detection means is identical to that which is instructed by the rotative direction reversion instruction switch 401*b*.

The safety confirmation means 403 serves to enable the reversion of the rotative direction of the engine only when the safety is maintained for the driver of the travelling machine. The safety confirmation means 403 confirms whether the reversion allowance conditions are satisfied which are required for reversing the rotative direction of the engine while the travelling machine is driven with the safety maintained when the rotative direction confirmation means 402 confirms that the present rotative direction of the engine is not identical to that instructed by the rotative direction instruction switch 401*b* before the reversion control step starts.

If the safety confirmation means 403 doesn't confirm that the reversion allowance conditions are satisfied, the control mode change-over means 404 makes the ignition position control 3 kept in the normal control mode whereby the ignition position is prohibited from advancing to the over spark advance position. On the other hand, if the safety confirmation means 403 confirms that the reversion allowance conditions are satisfied, the control mode change-over means 404 receives the reversion control instruction from the safety confirmation means 403 and changes the control mode of the ignition position control 3 to the reversion control mode whereby the ignition position advances to the over spark advance position.

The conditions for judging whether the reversion allowance conditions are satisfied which are required for reversing the rotative direction of the engine with the safety of the travelling machine maintained are as follows;

(1) the revolution $\underline{N}$ of the internal combustion engine being equal to or less than the set value; and (2) the opening degree of the throttle valve for adjusting the intake amount of the engine 1 being equal to or less the set value.

The safety confirmation means 403 judges the satisfaction of the reversion allowance conditions when the revolution $\underline{N}$ of the internal combustion engine is equal to or less than the set value $\underline{Ns}$ and also when the opening degree of the throttle valve is equal to or less than the set value and the dissatisfaction of the reversion allowance conditions when the revolution $\underline{N}$ of the internal combustion engine exceeds the set value $\underline{Ns}$ or when the opening degree of the throttle valve exceeds the set value.

As the safety confirmation means 403 confirms the satisfaction of the reversion allowance conditions, it allows the control mode change-over means 404 to change the control mode of the ignition position controller 3 to the reversion control mode while as the safety confirmation means 403 confirms the dissatisfaction of the reversion allowance conditions, it prohibits the control mode change-over means 404 from changing the control mode of the ignition position controller 3 to the reversion control mode.

The safety confirmation means 403 may be operated by the microcomputer conducting the predetermined program.

Figure 6:
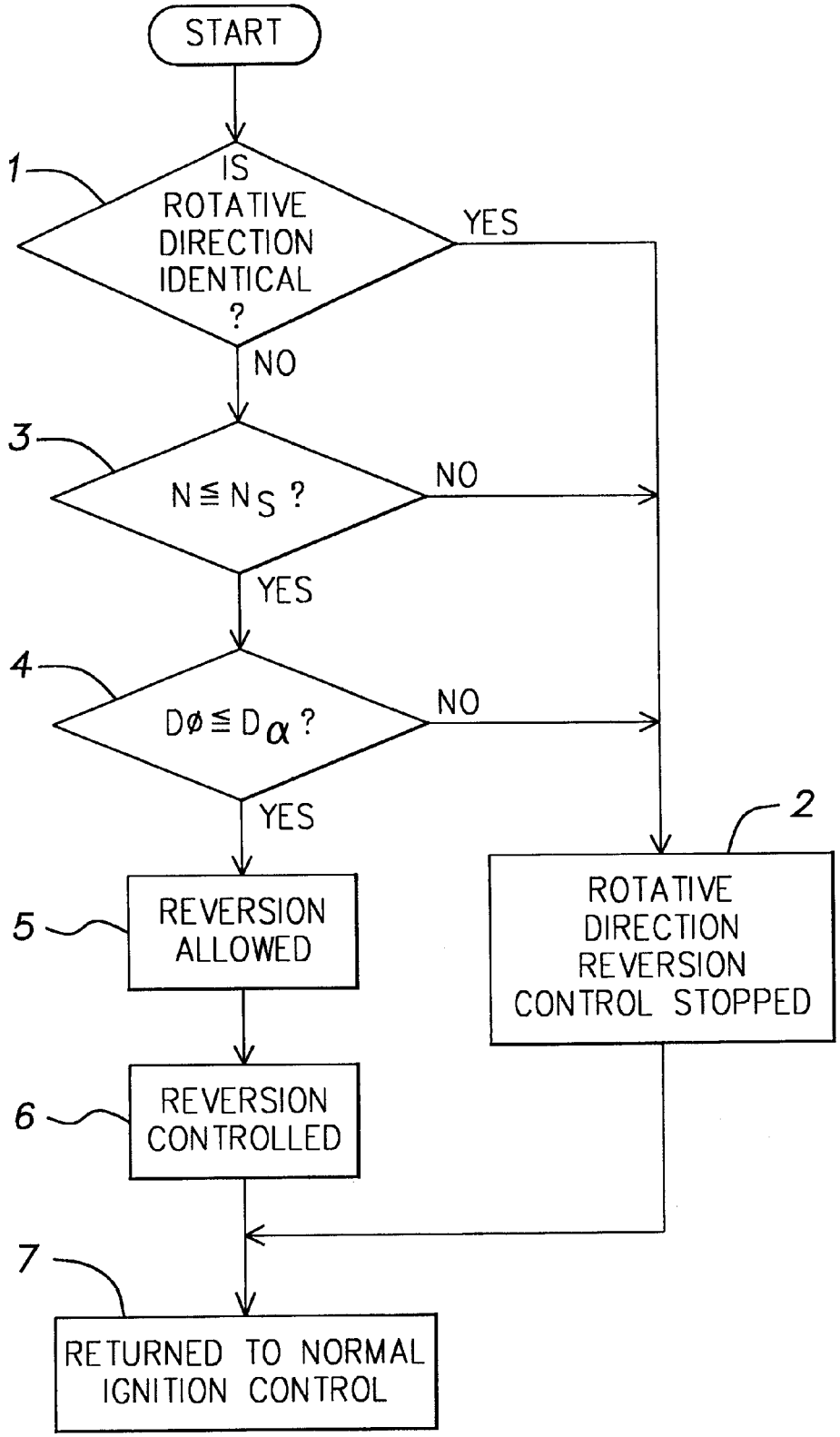
FIG. 6 is a flow chart showing one example of an algorithm of interruption routine of a program practiced by a microcomputer when the reversion of the rotative direction of the engine is controlled by the rotative direction change-over control system of the invention.

FIG. 6 illustrates one example of an algorithm of interruption routine of the program practiced by the microcomputer when the reversion instruction is generated.

In this example, at the step 1 of FIG. 6 wherein as the reversion instruction is given, whether the present rotative direction of the engine is identical to that instructed by the reversion instruction is confirmed. The rotative direction confirmation means 402 of FIG. 2 is realized by the confirmation step. At the rotative direction confirmation step 1, when it is confirmed that the present rotative direction of the engine is identical to that instructed by the reversion instruction, the process is transferred to the step 2 wherein the rotative direction change-over control is interrupted and the ignition position controller 3 has the normal ignition position control mode so as to control the ignition position in the normal manner.

At the step 1 of FIG. 6, when it is confirmed that the present rotative direction of the engine is not identical to that instructed by the reversion instruction, the process is transferred to the step 3 wherein whether the present revolution N of the engine is equal to or less than the set value Ns is judged. The set value Ns is determined as the maximum value of the revolution of the engine to be satisfied as one of the reversion allowance conditions which is so set at the fully lower value like the idling revolution of the engine.

In case that a clutch such as a centrifugal clutch which is engaged when the revolution of the input shaft exceeds a predetermined value is provided between the crank shaft of the engine and the drive portion of the travelling machine, the set value Ns of the revolution of the engine as a reference value which is to be used for judging whether the reversion allowance conditions are satisfied is so set to be less than the revolution of the engine at which the centrifugal clutch is engaged.

At the step 3 of FIG. 6, if the present revolution N of the engine exceeds the set value Ns, the process is transferred to the step 2 wherein the rotative direction change-over control system is interrupted and the ignition position controller 3 has the normal ignition position control mode so as to control the ignition position in the normal manner.

At the step 3 of FIG. 6, when it is confirmed that the present revolution N of the engine is equal to or less than the set value Ns, the process is transferred to the step 4 wherein whether the opening degree Dθ of the throttle valve is equal to or less than the set value Dα is judged. If it is confirmed that the opening degree Dθ of the throttle valve exceeds the set value Dα (which means that the accelerating operation of the engine is made), the dissatisfaction of the reversion allowance conditions is judged and the process is transferred to the step 2 wherein the rotative direction change-over control is interrupted and the ignition position control 3 has the normal ignition position control mode so as to control the ignition position in the normal manner.

At the step 4 of FIG. 6, when it is confirmed that the opening degree Dθ of the throttle valve is equal to or less than the set value Dα, the process is transferred to the step 5 wherein the reversion is allowed and then to the step 6 wherein the reversion control is made.

In this reversion control, the control mode of the ignition position controller 3 is transferred to the reversion control mode in which the ignition position is advanced to the over spark advance position appropriate for reversing the rotative direction of the engine. The over spark advance position is maintained until the reversion of the rotative direction of the engine is detected.

As the ignition operation is made at the over spark advance position, the fuel is ignited so that the cylinder is exploded under the condition that the piston of the engine is located pretty far away from the top dead center before the piston reaches the top dead center. Thus, the piston is forced back far away from the top dead center so that the engine is rotated in the reverse direction. When the reversion of the rotative direction of the engine is confirmed, the reversion control terminates and the process is transferred to the step 7 wherein the ignition position controller 3 returns the control mode to the normal ignition position control mode. Thus, the normal operation of the engine is made in the reverse condition of the rotative direction of the engine.

In this example, the safety confirmation means is accomplished by the judgment of the revolution of the engine at the step 3 and the judgment of the opening degree of the throttle valve at the step 4.

With the safety confirmation means formed as shown in FIG. 6, after the present revolution N of the engine is lowered to the value equal to or less than the set value Ns and the opening degree Dθ of the throttle valve is throttled to the value equal to or less than the set value Dα, the rotative direction reversion instruction switch 401*b* is operated to instruct the rotative direction of the engine to be reversed whereby the rotative direction of the engine can be reversed.

If the present revolution N of the engine exceeds the set value Ns or if the opening degree Dθ of the throttle valve is larger than the set value Dα, the safety confirmation means works even though the rotative direction reversion instruction switch 401*b* is operated to instruct the rotative direction of the engine to be reversed. Thus, the safety confirmation means prohibits the reversion control and therefore the rotative direction of the engine is never reversed.

As aforementioned, before the reversion control is made, it is judged whether the present revolution N of the engine is equal to or less than the set value Ns and whether the opening degree Dθ of the throttle valve is equal to or less than the set value Dα and only when the reversion allowance conditions of $N \leqq Ns$ and $D\theta \leqq D\alpha$ are satisfied, the reversion control is allowed. This effectively prevents the rotative direction of the engine from being abruptly reversed in the condition of the travelling machine being travelling or prevents the engine from being abruptly accelerated immediately after the rotative direction of the engine is reversed.

Although the conditions for judging whether the reversion allowance conditions are satisfied which are required for reversing the rotative direction of the engine with the safety of the travelling machine maintained are determined as (1) the revolution N of the internal combustion engine being equal to or less than the set value and (2) the opening degree of the throttle valve for adjusting the intake amount of the engine 1 being equal to or less the set value, it should be understood that the conditions are not defined to them.

They may be determined as (1) the revolution N of the internal combustion engine being equal to or less than the set value and (2) the brake operation member being operated on the brake side.

With the reversion allowance conditions determined as just aforementioned, a brake operation detector should be provided which detects the braking operation of the brake operating member.

Figure 5:
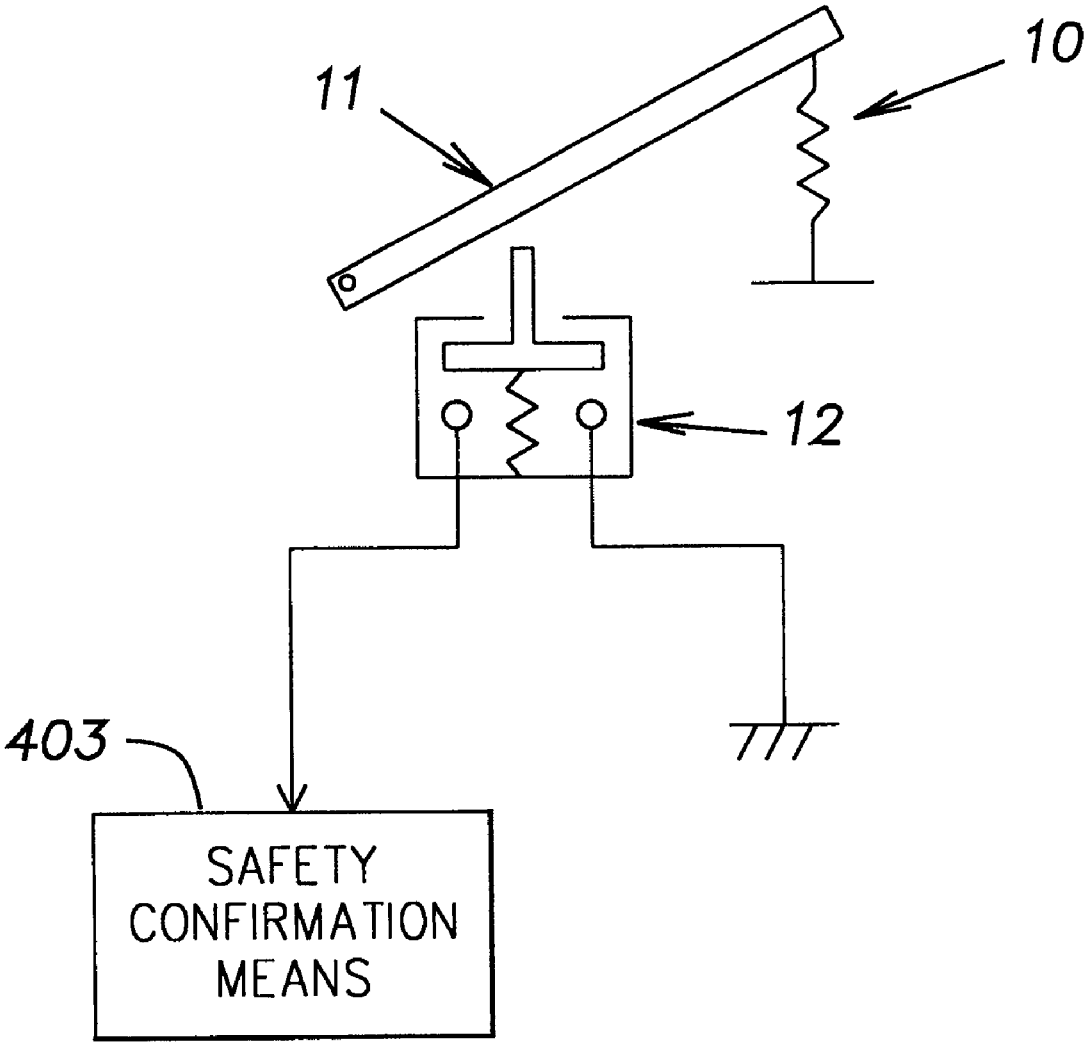
FIG. 5 illustrates a brake operating member and a sensor to detect whether the brake operating member is operated to the braking side thereof.

As shown in FIG. 5, a foot forcing type brake operating member 11 (a brake pedal, for example) may be provided which is urged to be released by a spring 10 and is provided with a brake operation detector which detects the brake operation of the brake operating member 11.

In the illustrated embodiment, the brake operation detector may comprise a brake detector switch 12 which is forced and closed by the brake operating member 11 when it is operated or forced down on the brake side.

A signal obtained from the brake operation detector switch 12 is input to the safety confirmation means 403. If a switch for lighting a brake lamp indicating the brake operation of the brake operating member 11 is provided so as to be associated with the brake operating member 11, then it may be used as the brake detection switch 12.

Figure 7:
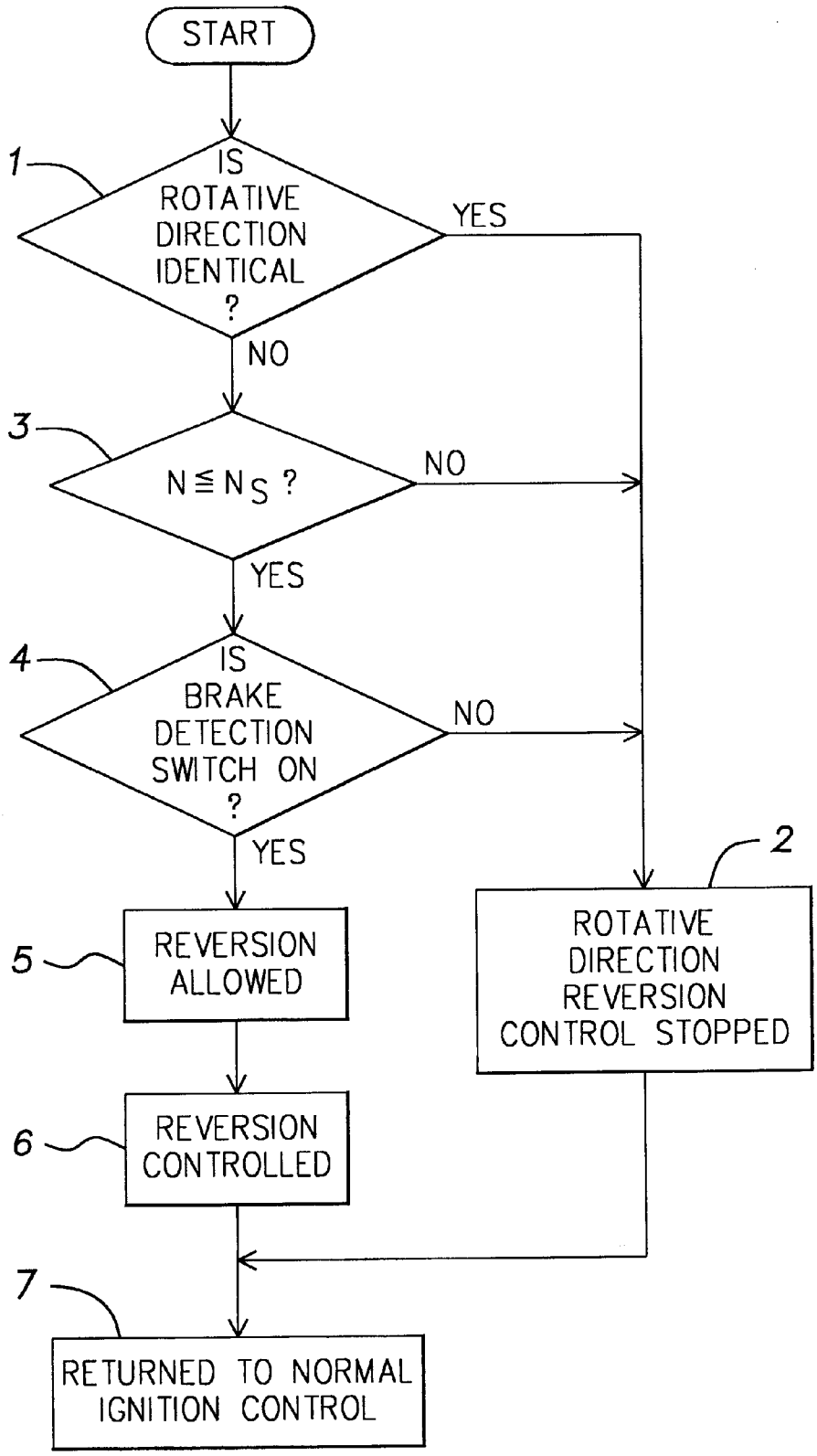
FIG. 7 is a flow chart showing another example of an algorithm of a program practiced by a microcomputer when the reversion of the rotative direction of the engine is controlled by the rotative direction change-over control system of the invention.

FIG. 7 illustrates one example of an algorithm of interruption routine of the program practiced by the microcomputer in case that (1) the revolution N of the internal combustion engine being equal to or less than the set value and (2) the brake operation member being operated on the brake side are the reversion allowance conditions.

In this example of FIG. 7, at the step 1 thereof wherein as the reversion instruction is given, the rotative direction of the engine is confirmed. At the rotative direction confirmation course of the step 1, when it is confirmed that the present rotative direction of the engine is identical to that instructed by the reversion instruction, the process is transferred to the step 2 where the rotative direction change-over control is interrupted and the ignition position controller 3 has the normal ignition position control mode so as to control the ignition position in the normal manner.

At the step 1 of FIG. 7, when it is confirmed that the present rotative direction of the engine is not identical to that instructed by the reversion instruction, the process is transferred to the step 3 where the revolution of the engine is judged.

At the step 3 of FIG. 7, if the present revolution N of the engine exceeds the set value Ns, which is considered as the dissatisfaction of the reversion allowance conditions, the process is transferred to the step 2 wherein the ignition position controller 3 has the normal ignition position control mode so as to control the ignition position in the normal manner.

At the step 3 of FIG. 7, when it is confirmed that the present revolution N of the engine is equal to or less than the set value Ns, the process is transferred to the step 4 wherein the operation of the brake operation member is confirmed. At this course, whether the brake detection switch 12 is turned on (whether the brake operation member is operated on the braking side) is confirmed. If it is confirmed that the brake detection switch is turned on (the brake operation member is operated on the braking side), then the process is transferred to the step 2 wherein the ignition position controller 3 has the normal ignition position control mode so as to control the ignition position in the normal manner.

At the step 4 of FIG. 7, when it is confirmed that the brake detection switch 12 is turned on (the brake operation member is operated on the braking side), the process is transferred to the step 5 wherein the reversion allowance instruction is generated and then to the step 6 wherein the reversion control is made.

In this example, the safety confirmation means is accomplished by the judgement of the revolution of the engine at the step 3 and the confirmation of the brake operation member at the step 4.

With the safety confirmation means 403 formed as shown in FIG. 7, after the present revolution N of the engine is lowered to the value equal to or less than the set value Ns and the brake is put on, the rotative direction reversion instruction switch 401*b* is operated to instruct the rotative direction of the engine to be reversed whereby the rotative direction of the engine is reversed.

If the present revolution N of the engine exceeds the set value Ns or if the brake is not put on, the safety confirmation means 403 works even though the rotative direction reversion instruction switch 401*b* is operated to instruct the rotative direction of the engine to be reversed. The safety confirmation means 403 prohibits the reversion control and therefore the rotative direction of the engine is never reversed.

As aforementioned, before the reversion control is made, it is judged whether the present revolution N of the engine is equal to or less than the set value Ns and whether the brake operation member is operated on the braking side and only when the revolution of the engine is equal to or less than the set value and also the brake operation member is operated on the braking side, the reversion control is allowed. This effectively prevents the rotative direction of the engine from being abruptly reversed in the condition of the travelling machine being travelling or prevents the engine from being abruptly accelerated immediately after the rotative direction of the engine is reversed.

In the embodiments of FIGS. 6 and 7, once the driver operates the rotative direction change-over control system (actually the rotative direction instruction switch 401*b*) so as to reverse the rotative direction of the engine, even though the operation is interrupted (the rotative direction instruction switch 401*b* is returned to the original position) before the reversion of the rotative direction of the engine is completed), the operation of reversion of the rotative direction will continue against the driver's intention.

In order to avoid such a situation, whether the reversion instruction should be maintained can be preferably confirmed before the reversion of the rotative direction of the engine is completed. With such instruction confirmation made, if the reversion instruction is interrupted before the reversion of the rotative direction of the engine is completed, then the reversion of the rotative direction of the engine can be stopped.

Figure 8:
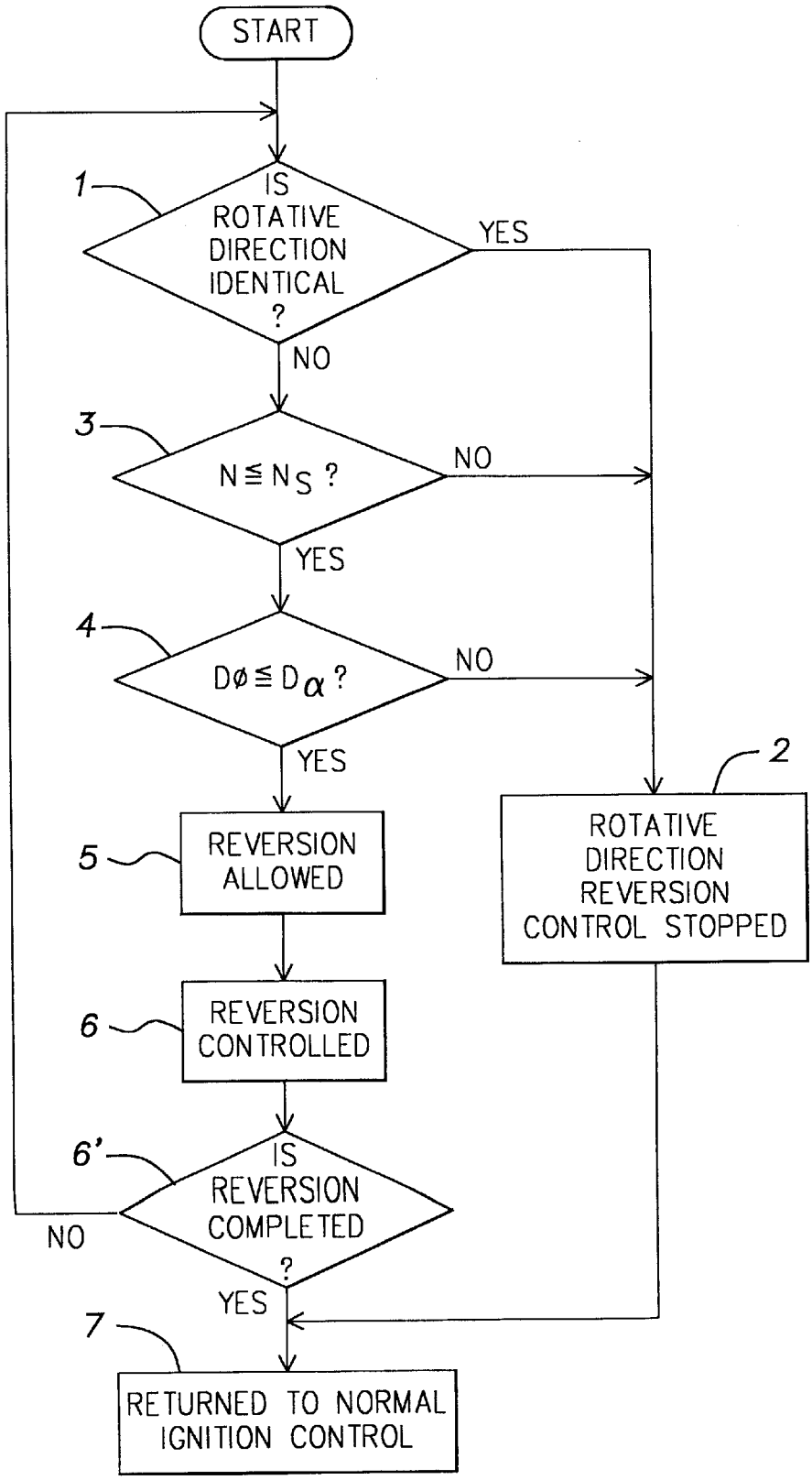
FIG. 8 is a flow chart showing further example of an algorithm of a program practiced by a microcomputer when the reversion of the rotative direction of the engine is controlled by the rotative direction change-over control system of the invention.
Figure 9:
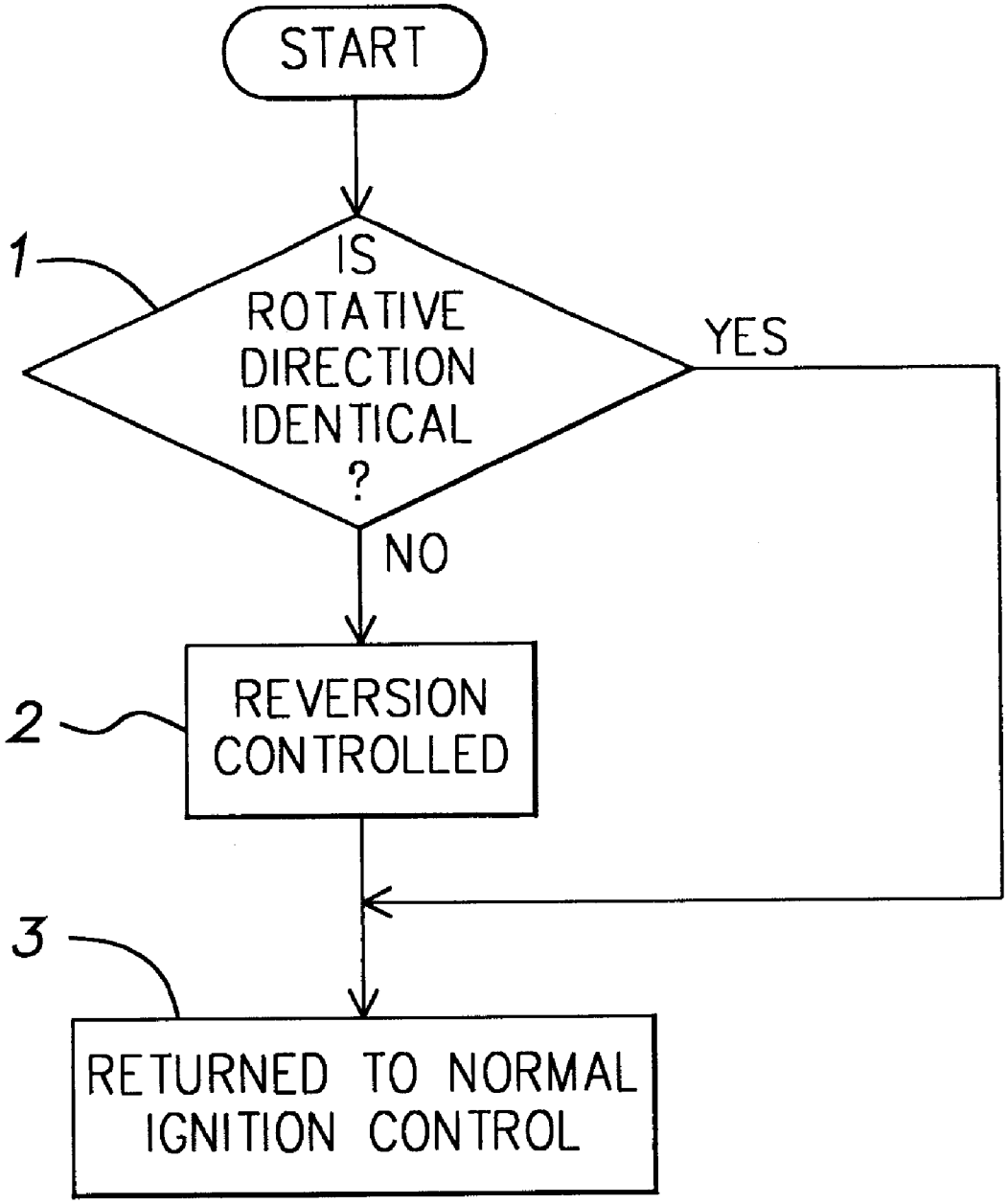
FIG. 9 PRIOR ART
FIG. 9 is a flow chart showing an algorithm of a program practiced by a microcomputer when the reversion of the rotative direction of the engine is controlled by the rotative direction change-over control system of the prior art.

FIG. 8 illustrates an algorithm of the program practiced by the microcomputer in case that whether the reversion instruction should be maintained can be repetitively confirmed before the reversion of the rotative direction of the engine is completed.

In this example of FIG. 8, the steps 1 through 6 are identical to those of FIG. 6, but the step 6' is inserted between the steps 6 and 7. At the step 6' of FIG. 8, after the control mode of the ignition position control 3 is changed to the reversion control mode at the step 6, whether the reversion of the rotative direction of the engine is made (the operation of reversion is completed) is confirmed. When the reversion of the rotative direction is not made, the process is transferred again to the step 1 wherein whether the rotative direction of the engine is identical to that instructed by the rotative direction instruction switch 401*b* is confirmed.

In this manner, after the operation of reversion starts with the rotative direction instruction switch 401*b* operated and before the operation of reversion of the rotative direction is completed, the rotative direction instruction switch 401*b* can be returned to the original position. At that time, it is confirmed that the rotative direction of the engine is identical to that instructed by the rotative direction instruction switch 401*b* which now instructs the present rotative direction of the engine. This causes the operation of reversion to be interrupted whereby the control mode of the ignition position control 3 is returned to the normal control.

Thus, it will be noted that after the driver operates the rotative direction instruction switch 401*b* to instruct the rotative direction to be reversed, the operation of reversion continues as long as the instruction switch is maintained at the same position, but it discontinues as the instruction switch 401*b* is returned to the original position. This prevents the reversion of the rotative direction of the engine from continuing to be operated against the driver's intention.

In this example of FIG. 8, the safety confirmation means is accomplished by the confirmation of the rotative direction of the engine while the operation of reversion of the rotative direction continues when it is confirmed that the operation of reversion of the rotative direction is not completed at the steps 6' and 1 of FIG. 8.

Also, the reversion interruption means is accomplished by the interruption of advancing the ignition position to the over spark advance position when it is confirmed by the rotative direction confirmation means that the rotative direction of the engine is identical to that instructed by the reversion instruction at the steps 1 and 2 of FIG. 8.

It will be understood by those skilled in the art that the condition of the opening degree of the throttle valve being equal to or less than the set value $D\alpha$ which is similar to that of FIG. 6 may be replaced by the condition of the brake operation member being operated on the braking side as similar to the embodiment of FIG. 7, which may be used as one of the reversion allowance conditions to be satisfied for reversing the rotative direction of the engine.

Although, in the illustrated embodiments, the two conditions of (1) the revolution of the engine being equal to or less than the set value and (2) the opening degree of the throttle valve being equal to or less than the set value or the two conditions of (1) the revolution of the engine being equal to or less than the set value and (2) the brake operation member being operated on the braking side may be used as the reversion allowance conditions to be satisfied for reversing the rotative direction of the engine, the three conditions of (1) the revolution of the engine being equal to or less than the set value, (2) the opening degree of the throttle valve being equal to or less than the set value and (3) the brake operation member being operated on the braking side may be used as the reversion allowance conditions to be satisfied for reversing the rotative direction of the engine, which establish the safety confirmation means.

Furthermore, if the travelling machines have any other peculiar conditions to be satisfied for reversing the rotative direction of the engine, then they may be preferably used when the reversion of the rotative direction of the engine is to be allowed.

Although the signal generator (the revolution sensor) of FIG. 3 comprises the two-step reluctor 602 including the height of the first portion 602*a* smaller than that of the second portion 602*b*, it may comprise the two-step reluctor including the first portion 602*a* of smaller width and the second portion 602*b* of larger width, which may generate the same signals.

With the change-over system of the rotative direction of the engine constructed in accordance with the invention, since the reversion operation of the engine is made only when the reversion allowance conditions are satisfied which are required for reversing the rotative direction of the engine while the travelling machine is driven with the safety maintained, the reversion of the rotative direction of the engine can be avoided when the reversion instruction is erroneously generated due to the unintentional operation by the driver or due to the reversion instruction generator broken down.

Furthermore, since the system of the invention may comprise rotative direction confirmation means to judge whether the rotative direction of the internal combustion engine is identical to that which is instructed by the reversion instruction when the unfinished reversion of the rotative direction of the internal combustion engine is judged and the change-over interruption means to interrupt the reversion of the rotative direction of the engine by stopping advancing the ignition position by the reversion control means when the rotative direction confirmation means confirms that the rotative direction of the engine is identical to that instructed by the reversion instruction.

Although some preferred embodiments have been described and illustrated with reference to the accompanying drawings, it will be understood by those skilled in the art that they are by way of examples, and that various changes and modifications may be made without departing from the spirit and scope of the invention, which is defined only to the appended claims.

What is claimed is:

1. A method of controlling a change-over of a rotative direction of a two cycle internal combustion engine used for driving a travelling machine comprising the step of controlling said change-over of said rotative direction of said engine by advancing an ignition position of said engine to an over spark advance position necessary for reversing said rotative direction of said engine when a reversion instruction is given instructing said reversion of said rotative direction of said engine and characterized by further comprising the steps of:

confirming whether reversion allowance conditions are satisfied which are required for reversing said rotative direction of said engine while said travelling machine is driven with safety maintained before said step of controlling said change-over of said rotative direction of said engine whereby said step of controlling said change-over is allowed to start when it is confirmed that said reversion allowance conditions are satisfied, but said step of controlling said change-over is prohibited from starting when it is confirmed that at least one of said reversion allowance conditions is dissatisfied; and confirming whether said rotative direction of said internal combustion engine is identical to that instructed by said reversion instruction while said reversion of said rotative direction is being operated and when it is confirmed that an operation of said reversion of said rotative direction is incomplete whereby said change-over of said rotative direction is interrupted by stopping advancing said ignition position of said internal combustion engine to said over spark advance position by said reversion control means when it is confirmed that said rotative direction of said engine is identical to that instructed by said reversion instruction.

2. A method of controlling a change-over of a rotative direction of a two cycle internal combustion engine used for driving a travelling machine comprising the step of controlling said change-over of said rotative direction of said engine by advancing an ignition position of said engine to an over spark advance position necessary for reversing said rotative direction of said engine when a reversion instruction is given instructing said reversion of said rotative direction of said engine and characterized by further comprising the steps of:

confirming that reversion allowance conditions are satisfied when a revolution of said engine is equal to or less than a set value and also when an opening degree of a throttle valve for adjusting an intake amount of said internal combustion engine is equal to or less than a set value and that said reversion allowance conditions are dissatisfied when said revolution of said engine exceeds said set value or when said opening degree of said throttle valve exceeds said set value before said step of controlling said change-over of said rotative direction of said engine whereby said step of controlling said change-over is allowed to start when it is confirmed by said step of confirming said reversion allowance conditions that said reversion allowance conditions are satisfied, but said step of controlling said change-over is prohibited from starting when it is confirmed that at least one of said reversion allowance conditions is dissatisfied; and confirming whether said rotative direction of said internal combustion engine is identical to that instructed by said reversion instruction while said reversion of said rotative direction is being operated and when it is confirmed that an operation of said reversion of said rotative direction is incomplete whereby said change-over of said rotative direction is interrupted by stopping advancing said ignition position of said internal combustion engine to said over spark advance position by said reversion control means when it is confirmed that said rotative direction of said engine is identical to that instructed by said reversion instruction.

3. A method of controlling a change-over of a rotative direction of a two cycle internal combustion engine used for driving a travelling machine comprising the step of controlling said change-over of said rotative direction of said engine by advancing an ignition position of said engine to an over spark advance position necessary for reversing said rotative direction of said engine when a reversion instruction is given instructing said reversion of said rotative direction of said engine and characterized by further comprising the steps of:

confirming that reversion allowance conditions are satisfied when a revolution of said engine is equal to or less than a set value and also when a brake operating member is operated on a braking side and that said reversion allowance conditions are dissatisfied when said revolution of said engine exceeds said set value or when said brake operating member is not operated on a braking side before said step of controlling said change-over of said rotative direction of said engine whereby said step of controlling said change-over is allowed to start when it is confirmed by said step of confirming said reversion allowance conditions that said reversion allowance conditions are satisfied, but said step of controlling said change-over is prohibited from starting when it is confirmed that at least one of said reversion allowance conditions is dissatisfied; and confirming whether said rotative direction of said internal combustion engine is identical to that instructed by said reversion instruction while said reversion of said rotative direction is being operated and when it is confirmed that an operation of said reversion of said rotative direction is incomplete whereby said change-over of said rotative direction is interrupted by stopping advancing said ignition position of said internal combustion engine to said over spark advance position by said reversion control means when it is confirmed that said rotative direction of said engine is identical to that instructed by said reversion instruction.

4. A system of controlling a change-over of a rotative direction of a two cycle internal combustion engine used for driving a travelling machine comprising reversion instruction generator means to generate a reversion instruction to instruct said rotative direction of said engine; safety confirmation means to confirm whether reversion allowance conditions are satisfied which are required for reversing said rotative direction of said engine while said travelling machine is driven with safety maintained and to allow said rotative direction of said engine to be reversed when it is confirmed that said reversion allowance conditions are satisfied, but to prohibit said rotative direction of said engine from being reversed when it is confirmed that at least one of said reversion allowance conditions is dissatisfied; reversion control means to reverse said rotative direction of said internal combustion engine by advancing an ignition position of said engine to an over spark advance position necessary for reversing said rotative direction of said internal combustion engine when said reversion instruction is given and also when said rotative direction of said engine is allowed to be reversed by said safety confirmation means; rotative direction confirmation means to confirm whether said rotative direction of said internal combustion engine is identical to that instructed by said reversion instruction while said reversion of said rotative direction is being operated and when it is confirmed by reversion completeness confirmation means that an operation of said reversion of said rotative direction is incomplete; and rotative direction change-over interruption means to interrupt said change-over of said rotative direction by stopping advancing said ignition position of said internal combustion engine to said over spark advance position by said reversion control means when it is confirmed by said rotative direction confirmation means that said rotative direction of said engine is identical to that instructed by said reversion instruction.

5. A system of controlling a change-over of a rotative direction of a two cycle internal combustion engine as set forth in claim 4, and wherein both of a revolution of said engine being equal to or less than a set value and an opening degree of a throttle valve for adjusting an intake amount of said internal combustion engine being equal to or less than a set value are determined as said reversion allowance conditions.

6. A system of controlling a change-over of a rotative direction of a two cycle internal combustion engine as set forth in claim 4, and wherein both of a revolution of said engine being equal to or less than a set value and a brake operating member being operated on a braking side are determined as said reversion allowance conditions.

* * * * *